US008282030B2

(12) United States Patent
Pallmann

(10) Patent No.: US 8,282,030 B2
(45) Date of Patent: Oct. 9, 2012

(54) DEVICE FOR COMMINUTING INPUT MATERIAL

(75) Inventor: Hartmut Pallmann, Zweibruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 142 days.

(21) Appl. No.: 12/777,694

(22) Filed: May 11, 2010

(65) Prior Publication Data

US 2010/0282886 A1 Nov. 11, 2010

(30) Foreign Application Priority Data

May 11, 2009 (DE) ..... 10 2009 020 708

(51) Int. Cl.
*B02C 13/20* (2006.01)
*B02C 7/12* (2006.01)

(52) U.S. Cl. ..... 241/188.2; 241/261.1

(58) Field of Classification Search ..... 241/261, 241/261.1, 188.2
See application file for complete search history.

(56) References Cited

U.S. PATENT DOCUMENTS

| | | | | |
|---|---|---|---|---|
| 407,751 | A * | 7/1889 | Walters | 241/163 |
| 1,451,424 | A * | 4/1923 | Head | 241/56 |
| 1,869,243 | A * | 7/1932 | Fraser | 241/247 |
| 2,039,264 | A * | 4/1936 | Seckendorff | 241/56 |
| 3,028,105 | A * | 4/1962 | Perrine | 241/188.1 |
| 3,815,835 | A * | 6/1974 | Apostol et al. | 241/188.2 |
| 4,152,081 | A | 5/1979 | Hesse | |
| 4,399,948 | A * | 8/1983 | Treffner et al. | 241/154 |
| 5,094,391 | A | 3/1992 | Tamashige et al. | |
| 7,451,944 | B2 * | 11/2008 | Hall et al. | 241/207 |
| 7,861,958 | B2 * | 1/2011 | Waznys et al. | 241/154 |
| 2004/0035967 | A1 * | 2/2004 | Johnson et al. | 241/207 |

FOREIGN PATENT DOCUMENTS

| | | |
|---|---|---|
| DE | 27 13 809 A1 | 10/1978 |
| DE | 202 11 899 U1 | 10/2002 |
| GB | 01331 A | 0/1915 |
| WO | WO 00/47325 | 8/2000 |

* cited by examiner

*Primary Examiner* — Faye Francis
(74) *Attorney, Agent, or Firm* — Muncy, Geissler, Olds & Lowe, PLLC

(57) ABSTRACT

A device for comminuting input material, especially for fine and ultrafine grinding of input material, includes a rotor revolving around a shaft inside a housing, the rotor having a cylindrical or conical jacket surface. An annular gap is present between the housing and the jacket surface, the gap forming a comminution zone and the input material being introduced axially to it. To increase the economic efficiency of the device, it is provided that a plurality of first pin-shaped comminuting tools for comminuting the input material are disposed over the circumference of the rotor, wherein the tools are aligned with their longitudinal direction perpendicular to the jacket surface in the direction of the housing.

20 Claims, 4 Drawing Sheets

DEVICE FOR COMMINUTING INPUT MATERIAL

This nonprovisional application claims priority under 35 U.S.C. §119(a) to German Patent Application No. DE 10 2009 020 708.2, which was filed in Germany on May 11, 2009, and which is herein incorporated by reference.

BACKGROUND OF THE INVENTION

1. Field of the Invention

The invention relates to a device for comminuting input.

2. Description of the Background Art

Comminution devices are used primarily for comminution of input material by impact or striking, wherein comminution down to very fine grinding is possible. For example, devices of this class are used in the food industry for fine grinding of fat-containing beans, such as cacao or coffee, or beating and homogenizing fruit pulps. In the chemical industry, devices of this class are used, for example, for producing pigments or grinding polymers. The comminution of soft-elastic materials such as rubber or used tire granules is also possible, generally in conjunction with the introduction of cooling power before the grinding process, for example by supplying liquid nitrogen to make the input material brittle.

Pin mills are known with disks disposed coaxially inside a housing and at a distance from one another, wherein one rotates or both rotate with differential speeds. The disks have comminuting pins on the disk surfaces facing one another, which overlap in the space between the disks in the axial direction. In this process, the comminuting pins of each disk sit on circumferential circles moving concentrically relative to the axis of rotation, wherein the radii of the circumferential circles of one disk differ from those of the other disk to permit mutual combing of the opposing comminuting pins during rotation. The input material is introduced axially to such pin mills through a central opening in one of the disks and deflected in the radial direction by impact on the other disk so that it flows radially through the comminution zone formed by the comminuting pins and is withdrawn after its emergence from the comminuting gap formed by the disk. A machine of this type is described, for example, in DE 27 13 809, which corresponds to U.S. Pat. No. 4,152,081.

A characteristic feature of the pin mills known from the conventional art is their annular disk shaped comminution zone, which extends in a radial plane relative to the axis of rotation, thus has a two-dimensional form. The comminution zone is thus passed through radially, wherein the material particles are driven radially outward both by the entrainment force of the carrier gas stream and by the centrifugal force induced by the circular motion. Therefore, the material to be comminuted wanders through the comminution zone relatively rapidly, so that the action time available to the comminuting pins for breaking down the input material is relatively brief.

This type of construction further means that for the comminuting pins necessary for comminution, only the opposing disk surfaces are available, which considerably limits the number of comminuting pins. In addition, as a result of the radial minimum distance between the comminuting pins that is to be maintained, the play for the arrangement of the comminuting pins is further limited. As a result, in known mills, the density of the comminuting pins is not particularly high, and thus the performance capability of such pin mills is limited.

Since the comminuting pins are disposed upon different circumferential circles relative to the axis of rotation, the comminuting pins disposed on the outer circumferential circles rotate with a higher circumferential velocity than those located further inside. Thus the comminuting pins, depending on their radial difference from the axis of rotation, strike the material to be ground with different energy, entailing the risk that the fine-ground end product displays a greater dispersion in degree of fineness.

SUMMARY OF THE INVENTION

It is therefore an object of the present invention to provide a pin mill that permits a more intensive and qualitatively superior processing of the input material compared with the state of the art.

Since the comminuting pins are subject to extensive wear because of the impact of the input material and therefore must be changed frequently, an additional task of the invention includes minimizing the down times of a device by providing for easy and rapid replacement of the comminuting pins insofar as possible.

The invention breaks away from the common concept of a two-dimensional comminution zone in pin mills and provides for the first time for making a three-dimensional comminution zone. This is done according to the invention by using a cylindrical or conical rotor, which is fitted over its circumference with first pin-shaped comminution tools. In this way a high pin density can be attained within the comminution zone with only slight enlargement of the housing. Therefore, disproportionately large amounts of work can be performed with relatively small machines.

The rotor design according to the invention leads to an annular gap between the rotor and housing, through which the input material passes essentially axially. Centrifugal forces occurring within the comminution zone therefore have no appreciable influence on the flow velocity of the input material and therefore also not on its residence time. As a result, the input material can be retained longer in devices according to the invention, with the advantage of particularly intensive processing.

The arrangement of the comminuting tools on a cylindrical or conical rotor, in addition, has the advantage that all comminuting tools have essentially the same circumferential velocity, which results in a uniform processing of the input material and leads to a uniform end product of very high quality that falls within narrow tolerances in terms of shape and size.

The comminution work can be produced by the rotor alone in a device according to the invention. However, an embodiment is preferred in which the rotor interacts with a stator arranged on the interior of the housing. Particularly preferred is a stator that is likewise equipped with two pin-shaped size reduction tools similar or identical to those of the rotor, entering into combing interaction with one another. In this way very intensive size reduction takes place, which is primarily suitable for fine and ultrafine grinding.

The arrangement of the comminuting tools on the rotor or stator is not arbitrary, but an arrangement is preferred in which the comminuting tools are disposed in several radial planes at an axial distance from one another. This results in uniform conditions, which contribute to quiet machine operation. For adaptation to the input material and the method of comminution, the possibility exists of assigning the comminuting tools on the rotor and/or stator to different radial planes aligned with to a mantle line or with a circumferential offset from one radial plane to the next.

According to an embodiment of the invention, the rotor is essentially made in one piece, in other words, it has a monolithic, thus one-piece base in which for example the comminuting tools are inserted directly. Such a base is very simple to manufacture, since no parts need to be assembled. In addition, it is characterized by a high rotational motion accuracy and high precision. The replacement of all comminution tools is done simultaneously by replacing the entire rotor.

To further minimize the machine down times caused by replacement of worn-out tools, a particularly preferred embodiment of the invention provides for equipping the rotor and/or stator with a jacket on which the respective comminuting tools are arranged. This has the advantage that the replacement of the comminuting tools can take place outside of the device, thus with operation continuing, wherein by keeping available an additional rotor or stator jacket that is already fitted with unused comminution tools, the replacement times are limited to the removal and installation of the jacket.

Both in the case of a monolithic rotor and in the variant with a rotor jacket, a plurality of possibilities come under consideration for fastening the comminuting tools, for example press-fit, screw fastenings, gluing, shrink-fit and the like.

In contrast, however, a type of fastening is preferred in which the comminuting tools are merely inserted from the inside of the rotor and/or stator jacket into penetrating openings. Through a broadened design of the comminuting tools in the anchoring area and a complementary design of the jacket in the area of the openings, a first fixation of the comminuting tools in the rotor or stator jacket is achieved. The final anchoring takes place with the fitting together of the base and rotor jacket or top and stator jacket, wherein the base with its outer circumference and the top with its inner circumference forms a thrust-bearing surface for the comminuting tools. The comminuting tools are thus clamped between the base and rotor jacket or upper piece and stator jacket in this way. This type of fastening makes it possible to further shorten the tool replacement times.

To achieve rapid replacement of the rotor jacket with only a few manipulations, a radially inwardly directed annular flange is formed on the upper jacket edge, said flange abutting with the front side of the base piece of the rotor and being tensioned against the base piece with a plate to clamp it in place. The stator jacket is likewise fixed by a clamping type of fastening during the setting of the housing upper piece on the lower piece or by providing a clamping ring on the face of the upper piece, of larger diameter, on the top piece.

To achieve a pre-comminution step within a device according to the invention, opposite the material inlet in the housing, opening concentrically to the axis of rotation, an impact disk is provided on the front face of the rotor, said disk optionally being provided over its circumference with several impact strips and breaking down the larger pieces of the input material in a preliminary way. Preferably the impact disk simultaneously performs the function of fixing the rotor jacket on to the base piece.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
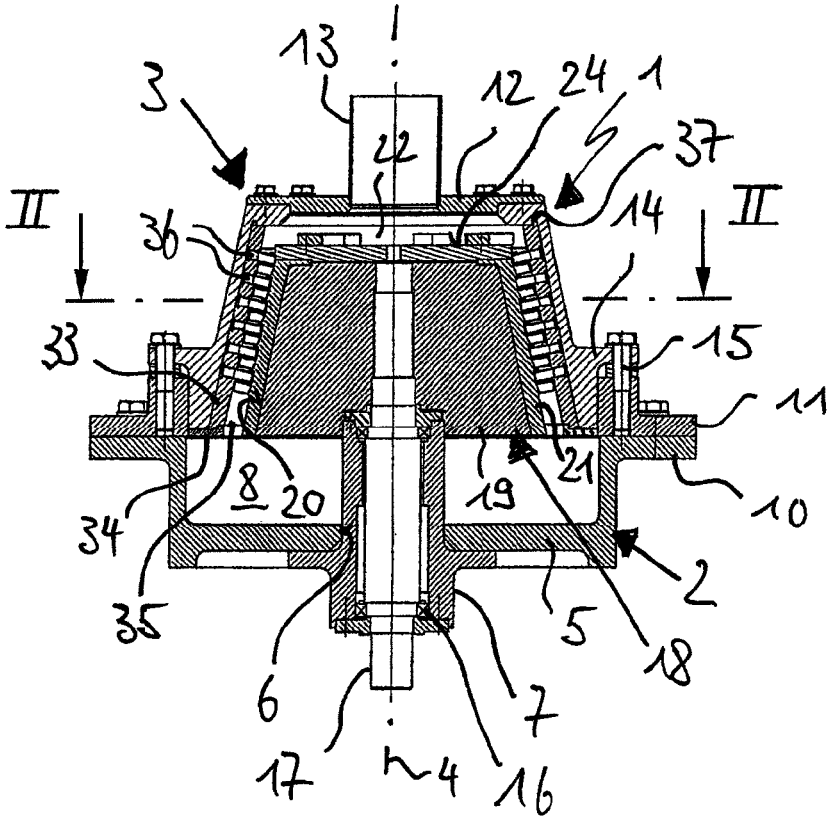
FIG. 1 is a longitudinal section through a device according to the invention along line I-I in FIG. 2.
Figure 2:
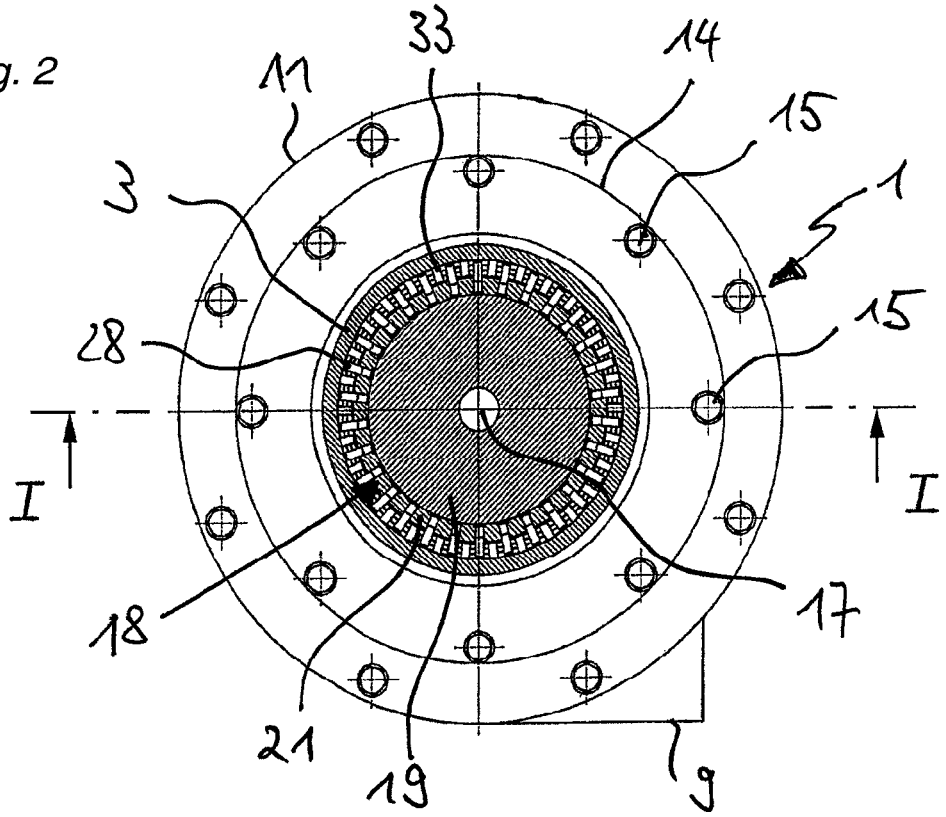
FIG. 2 is a cross section through the device shown in FIG. 1 along the line II-II there.

The general structure of a device according to the invention is apparent from FIGS. 1 and 2. The figures show a housing 1, which is made up of a cylindrical lower piece 2 and a bell-shaped upper piece 3. The longitudinal axis of the housing 1 is provided with the reference symbol 4. The lower piece 2 is closed off downward by a base 5, in which a circular opening 6 is disposed concentric to the shaft 4. Opening 6 serves to receive an essentially cylindrical shaft bearing 7, which is screwed onto the base 5 coaxially to the shaft 4 with a flange connection. The upper end of the shaft bearing 7 extends into the area of the upper piece 3. In this way, within the lower piece 2, an annular channel 8 is formed, which opens over a material outlet 9 from the housing 1 that runs tangentially to the shaft 4. The upper terminus of the bottom piece 2 forms a circumferential annular flange 10, to which a support ring 11 of angular cross-section is fastened.

As was previously mentioned, the external shape of the upper piece 3 resembles a bell, while the inner circumference of the upper piece 3 has a conical shape and serves to receive a stator. The upper side of the upper piece 3 is closed by a removable lid 12, which has a centered opening in the area of the shaft 4, followed coaxially with an inlet port 13 for filling the device with input material.

The foot area of the upper piece 3 is designed with its outer circumference complementary to the inner circumference of the support ring 11, so that the upper piece 3 can be inserted with its foot area axially into the lower piece 2. For reliable fastening of the upper piece 3 on the lower piece 2 an annular flange 14 proceeding plane-parallel to the outer circumference and coaxially is provided, which is fastened to the lower piece 2 with screws 15.

Within the shaft bearing 7, the drive shaft 17 directed coaxially to the shaft 4 is held rotatably within the shaft bearing 7. The lower end of the drive shaft 17, lying outside the housing 1, is connected to a rotary drive, not shown in further detail. The opposite end, lying in the inner region of the housing 1, extends far into the region of the upper piece 3 and serves for irrotatably receiving a rotor 18, the more specific design of which will be explained in further detail with additional reference to FIGS. 3 to 5.

The rotor 18 is made up of several sections and comprises a monolithic base piece 19 in the form of a truncated cone, which is seated irrotatably on the drive shaft. The outer circumference 20 of the base piece 19 is surrounded in a form-locking manner by a rotor jacket 21, the more detailed design of which is apparent primarily from FIG. 5. Essentially the rotor jacket 21 has a hollow truncated cone-shaped piece 22, which is slid axially onto the base piece 19 and an annular flange 23, extending in a radial plane to the shaft 4, which is formed on the upper, smaller-diameter inner circumference of the hollow truncated cone-shaped piece 22. In the assembled state of the rotor 18, the underside of the annular flange 23 comes to lie in a complementary-shaped, annular indentation in the upper front face 24 of the rotor 18. The annular flange 23 thus serves as a detent and supporting surface for the positionally accurate axial and radial seating of the rotor jacket 21 on the base piece 19.

Figure 5:
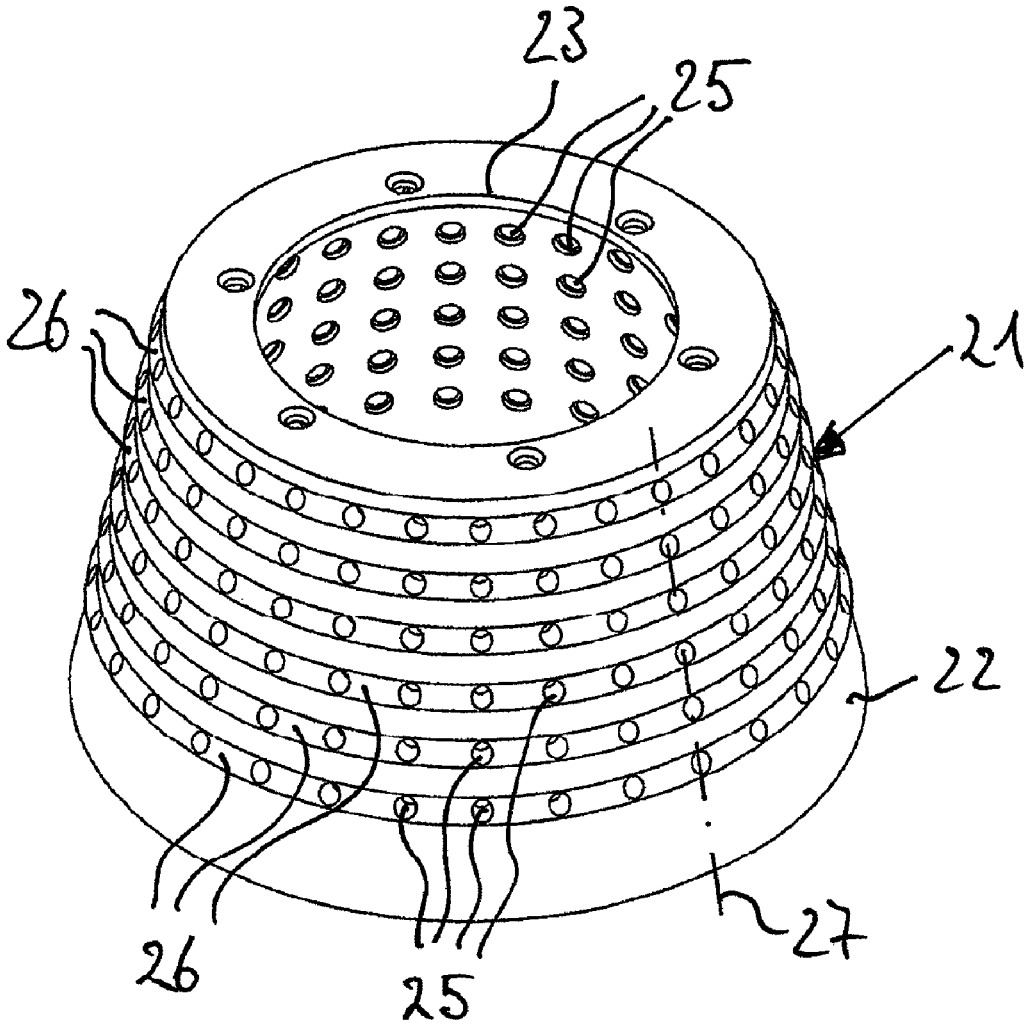
FIG. 5 is an oblique view of the rotor jacket shown in FIGS. 3 and 4 without comminuting tools.

As FIG. 5 in particular shows, the rotor jacket 21 is penetrated by a plurality of holes 25, which are grouped in radial planes 26 at axial intervals, wherein the holes 25 of each radial plane 26 are arranged at uniform circumferential distances. In the present exemplified embodiment, the holes 25 of adjacent radial planes lie in each case on common mantle lines; one of these is shown as a representative and designated by 27. Also falling within the framework of the invention, however, are embodiments in which the holes 25 of two adjacent radial planes 26 are disposed with a circumferential displacement relative to one another, for example in half the circumferential distance of two holes 25. The holes 25 serve for precisely fitting accommodation of the first pin-shaped comminuting tools 28.

Figure 3:
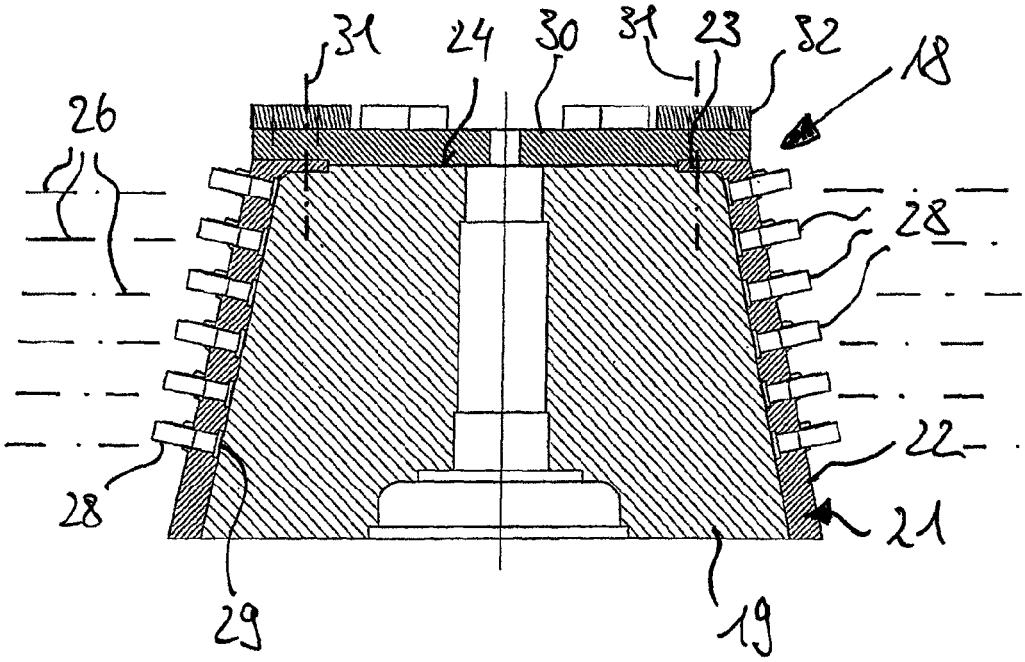
FIG. 3 is a longitudinal section through a rotor according to the invention on a larger scale.
Figure 4:
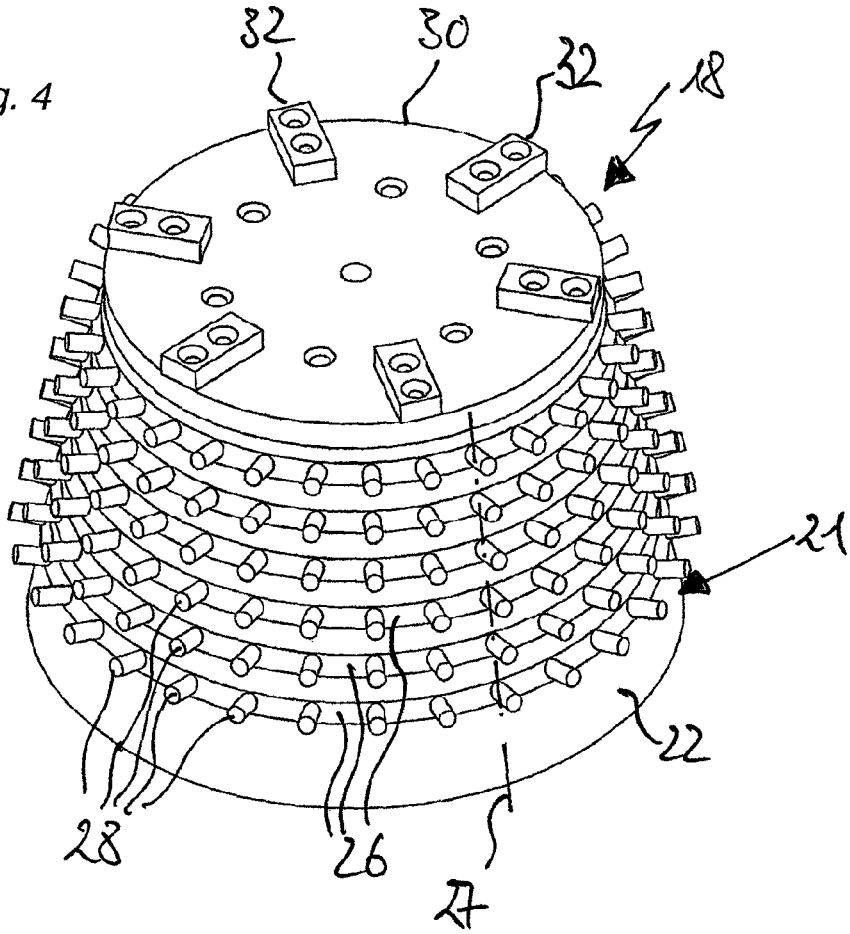
FIG. 4 is an oblique view of the rotor shown in FIG. 3.
Figure 6:
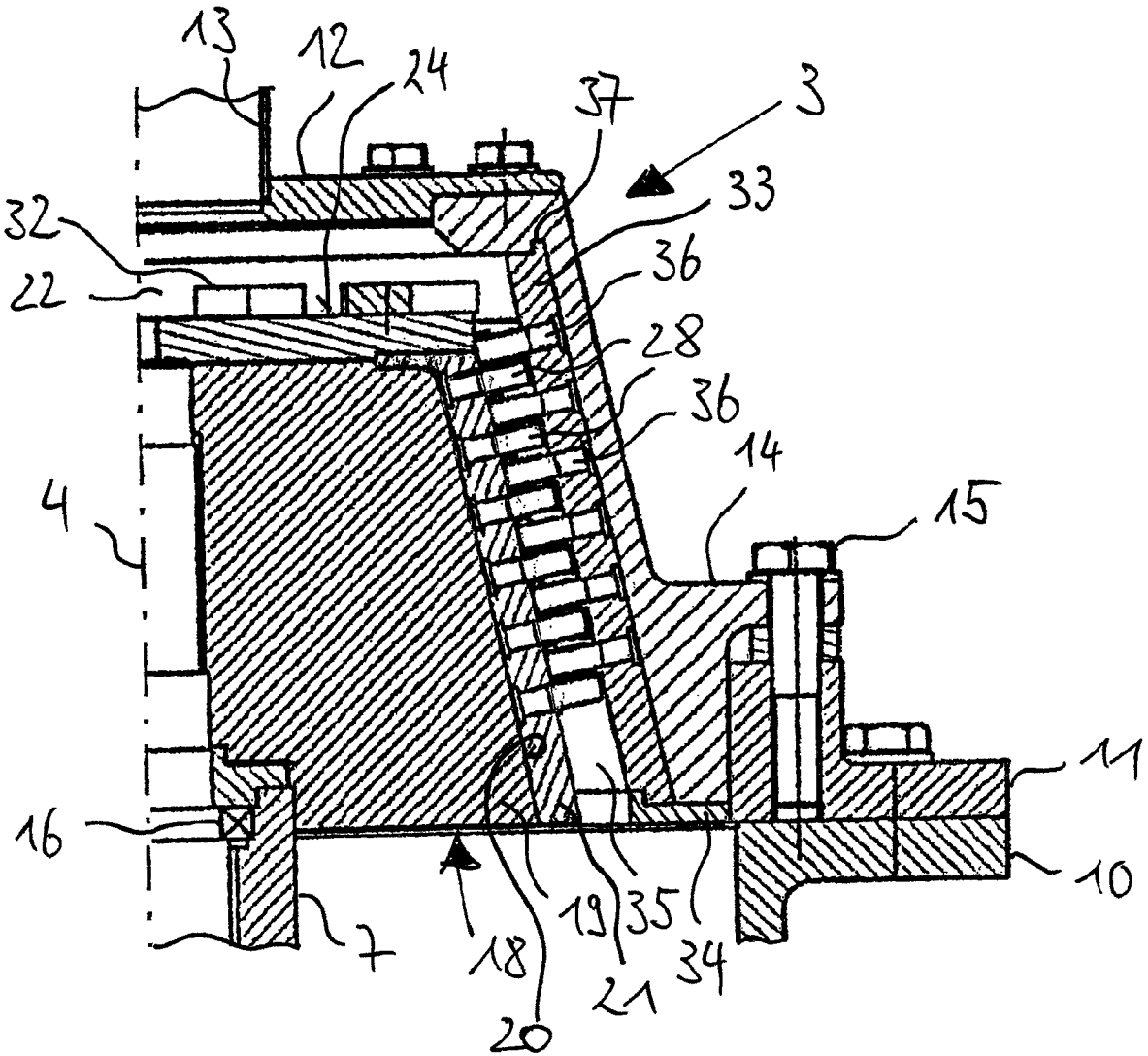
FIG. 6 is a cutaway of the longitudinal section shown in FIG. 1 on a larger scale.

Each of the first comminution tools 28 have a one-piece cylindrical pin, for example made of steel or ceramic, with a diameter between for example 5 mm and 10 mm, which on one end has a disk-like head broadening 29 (FIGS. 3 and 6). As is apparent from FIGS. 3 and 6, such comminuting tools 28 are passed through the holes 25 from the interior of the rotor jacket 21, wherein the broadened head 29 comes to rest in a complementary indentation on the inner circumference of the rotor jacket 21, thus coming to end flush with the inner circumference of the rotor jacket 21. There the base piece 19 presses with its outer circumference against the rotor jacket 21 and the heads 29 and in this way forms an abutment to fix the comminuting tools 28 in their operating position. A rotor 18 completely equipped with comminuting tools 28 is clearly shown in FIG. 4. There one also sees that the comminuting tools 28 project perpendicularly out of the circumferential surface of the rotor jacket 21, which in the case of conical-shaped rotors 18 means that the comminuting tools 21 are not aligned in the radial direction, in other words, they are not perpendicular to the shaft, but form an angle with the radial planes 26, corresponding to the conicity of the rotor 18.

The front face 24 of the rotor 18 is covered with an impact disk 30 arranged coaxially to the shaft 4 and its outer edge extends to the outer circumference of the rotor jacket 21. Here the impact disk 30 overlaps the annular flange 23 radially; wherein the top side of said annular flange comes to lie in a complementary shaped indentation on the underside of the impact disk 30. In this way, the annular flange 23 is embedded in a positive-locking manner between the base piece 19 and the impact disk 30. Thus the impact disk 30 clamps the annular flange 23 and thus the rotor jacket 21 against the base piece, which takes place by means of the screws indicated by 31, which extend through the impact disk 30 and the annular flange into the base piece 19.

On the top side of the impact disk 30, in the area of the outer circumference, six rectangular impact strips 32 are fastened, which are diametrically opposite one another in pairs with radial alignment. By maintaining an axial distance between the impact disk 30 and the cover 12 or the inlet port 13, a disk-like chamber 22 is formed, in which pre-comminution of the input material takes place.

In addition, FIGS. 1, 2 and 6 show a stator coaxially surrounding the rotor 18 with a hollow truncated cone shaped stator jacket 33, which extends in a positive-locking fashion along the inner circumference of the housing upper part 3. The upper edge of the stator material 33 has an annular projection 37 for centering and interlocking with the upper part 3. The lower edge is enclosed by a clamping ring 34, which is screwed together with the upper piece 3. In this process, the annular shoulder molded onto the inner circumference of the clamping ring 34 engages behind an annular attachment piece at the adjacent end of the stator jacket 33. In this way the stator jacket 33 is fastened by clamping in the upper housing part 3. The internal circumference of the stator jacket 33 proceeds at a uniform radial distance to the outer circumference of the rotor 18, resulting in the formation of an annular gap that forms the comminution zone into which the first comminuting tools 28 extend.

In analogy to the rotor jacket 21, the stator jacket 33 is also penetrated by a plurality of boreholes, which serve to receive two pin-like comminuting tools 36, which correspond in type to the first comminuting tools 28. The holes and the second comminuting tools 36 are disposed respectively in axially spaced radial planes, wherein the relative position of the radial planes of the stator jacket 33 relative to the radial planes 26 of the rotor jacket 31 is such that an axial offset results in a combing arrangement of the first comminuting tools 28 and second comminuting tools 36.

The type of fastening of the second comminuting tools 36 in the stator jacket 33 also corresponds to that achieved with the rotor jacket 21, so that the statements made regarding that apply appropriately. The comminuting tools 36 have a broadened head, which lies in a positive-fitting indentation and ends flush with the outer circumference of the stator jacket 33. In this process the upper part 3 presses from behind against the circumferential surface of the upper piece 3 and the ends of the comminuting tools 36 and in this way retains these in the indentations.

A device according to the invention operates as follows. Through the input ports 13, the input material axially enters the chamber 22, where a first impact of the input material on the impact disk 30 takes place. There the input material is deflected in the radial direction and driven radially outward by centrifugal force, where it is captured and pre-comminuted in the outer circumferential area of the impact disk by the rotating impact strips 32 thereon.

Then the pre-comminuted input material is deflected in an axial direction, whereupon it enters into the annular gap 35 and is further broken up and comminuted there between the rotating first comminuting tools 28 and second, fixed comminuting tools 36. The sufficiently processed input material leaves the annular gap 35 axially toward the bottom and enters the annular channel 8, from where it passes out of the housing 1 via the material outlet 9.

For changing the tools, first the upper part 3 of the housing 1 is removed. Then, after releasing the impact disk 30, the rotor jacket 21 can be pulled off axially from the base piece 19 of the rotor 8 and replaced by a rotor jacket 21 equipped with new comminuting tools 28. The replacement of the stator jacket 33 takes place in a similarly simple, rapid manner; after releasing the clamping ring 34, this can be removed axially from the top piece 3.

The replacement of the comminuting tools 28 on the rotor jacket 21 or the comminuting tools 36 on the stator jacket 33 is done by sliding the comminuting tools out of the corresponding holes and inserting new comminuting tools 28, 36 until their broadened heads come to lie in the complementary-shaped indentations in the rotor jacket 21 or stator jacket 33.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for comminuting input material for fine and ultrafine grinding of input material, the device comprising:

a housing;

a rotor rotating around a shaft inside disposed within the housing, the rotor having a conical jacket surface, wherein an annular gap formed between the housing and the jacket surface forms a comminution zone into which the input material is introduced axially; and a plurality of first comminuting tools that are pin-shaped for comminuting the input material, the first pin-shaped comminuting tools being disposed on the rotor, wherein the first pin-shaped comminuting tools are aligned with their longitudinal direction perpendicular to the jacket surface in the direction of the housing, and wherein the rotor includes an end surface perpendicular to the axis of rotation and including an opening in the housing for introducing input material onto the end surface of the rotor such that the input material must move across the end surface before reaching the plurality of first comminuting tools.

2. The device according to claim 1, further comprising a stator provided on an inner circumference of the housing, the stator being located opposite the jacket surface of the rotor and is configured to interact with the first comminuting tools.

3. The device according to claim 2, wherein the stator has second comminuting tools that are pin-shaped and that extend axially parallel to the first comminuting tools of the rotor in a direction of the rotor and interdigitate with the first comminuting tools.

4. The device according to claim 1, wherein the first and/or second comminuting tools are respectively arranged in several axially spaced radial planes on the circumference of the rotor and/or stator.

5. The device according to claim 1, wherein the first and/or second comminuting tools of a radial plane are disposed at uniform circumferential distances on the rotor and/or stator.

6. The device according to claim 1, wherein the first and/or second comminuting tools of adjacent radial planes, in each case, are disposed on a mantle line of the rotor and/or stator.

7. The device according to claim 1, wherein the first and/or second comminuting tools of adjacent radial planes are disposed with a circumferential offset relative to one another.

8. The device according to claim 1, wherein the rotor has a monolithic base piece in which the first comminuting tools are anchored.

9. The device according to claim 1, wherein the rotor is made in several parts with a base piece and a rotor jacket disposed coaxially on the base piece, and wherein the first comminuting tools are fastened to the rotor jacket.

10. The device according to claim 3, wherein the stator comprises a stator jacket that is disposed coaxially to the shaft on an inner circumference of the housing, and wherein the second comminuting tools are fastened to the stator jacket.

11. The device according to claim 9, wherein the rotor jacket and/or stator jacket have penetrating openings into which the first and/or second comminuting tools are inserted and secured in position.

12. The device according to claim 9, wherein the first and/or second comminuting tools have a cross sectional enlargement in their anchoring area to take up radial forces and the openings in the rotor jacket and/or stator jacket are formed complementary to this.

13. The device according to claim 11, wherein the openings in the rotor jacket and/or the openings in the stator jacket are closed on one side.

14. The device according to claim 10, wherein the stator jacket with its upper circumferential rim and lower circumferential rim is fastened in the housing by clamping.

15. The device according to claim 1, wherein the device has a material inlet opening into the housing concentric to the shaft, and wherein the rotor on a front face thereof facing the material inlet has an impact disk for a preliminary comminution.

16. The device according to claim 15, wherein the impact disk has impact strips on its circumference.

17. The device according to claim 9, wherein the rotor jacket at one circumferential rim has an annular flange disposed in a radial plane, which rests on the front side of the base piece.

18. The device according to claim 17, further comprising a concentric clamping plate that clamps the annular flange against the base piece.

19. The device according to claim 1, wherein the plurality of first comminuting tools that are pin-shaped each have a longitudinal axis and are disposed on the rotor such that the longitudinal axes are not perpendicular to the shaft.

20. The device according to claim 1, wherein the end surface includes impact strips for partially comminuting the input material before the input material is acted upon by any of the plurality of first comminuting tools.

* * * * *